US009498690B2

(12) United States Patent
Carlson et al.

(10) Patent No.: US 9,498,690 B2
(45) Date of Patent: Nov. 22, 2016

(54) BAT WITH MULTIPLE HITTING PROFILES

(71) Applicant: Baden Sports, Inc., Renton, WA (US)

(72) Inventors: Lawrence E. Carlson, Santa Clarita, CA (US); Joseph V. Severino, Escondido, CA (US)

(73) Assignee: Baden Sports, Inc., Renton, WA (US)

( * ) Notice: Subject to any disclaimer, the term of this patent is extended or adjusted under 35 U.S.C. 154(b) by 0 days.

(21) Appl. No.: 14/562,693

(22) Filed: Dec. 6, 2014

(65) Prior Publication Data

US 2016/0158617 A1 Jun. 9, 2016

(51) Int. Cl.
*A63B 69/00* (2006.01)

(52) U.S. Cl.
CPC .... *A63B 69/0002* (2013.01); *A63B 2069/0008* (2013.01); *A63B 2208/0204* (2013.01)

(58) Field of Classification Search
CPC ..... A63B 59/00; A63B 59/18
USPC ..... 473/566, 567, 565, 568, 457, 564, 519, 473/520, 451
See application file for complete search history.

(56) References Cited

U.S. PATENT DOCUMENTS 5,364,095 A * 11/1994 Easton ..... A63B 59/06 473/566
5,452,889 A * 9/1995 Lewinski ..... A63B 53/00 446/267
6,176,795 B1 * 1/2001 Schullstrom ..... A63B 59/06 473/520
7,867,114 B2 * 1/2011 Sutherland ..... A63B 59/06 473/567
2003/0004020 A1 * 1/2003 Ogawa ..... A63B 59/0092 473/564
2004/0152545 A1 * 8/2004 Fritzke ..... A63B 59/06 473/564
2006/0276270 A1 * 12/2006 Haney ..... A63B 21/0602 473/457
2007/0254753 A1 * 11/2007 Bleecker ..... A63B 53/14 473/568
2009/0131206 A1 5/2009 Leinert
2011/0111894 A1 5/2011 Thouin
2014/0235378 A1 * 8/2014 Albin ..... A63B 59/06 473/564

FOREIGN PATENT DOCUMENTS

JP 54254/1989 12/1990
JP 9420/1991 8/1992

OTHER PUBLICATIONS

International Search Report of PCT/US2015/063971 mailed Mar. 15, 2015, 9 Pages.

* cited by examiner

*Primary Examiner* — Gene Kim
*Assistant Examiner* — Rayshun Peng
(74) *Attorney, Agent, or Firm* — Lowe Graham Jones PLLC

(57) ABSTRACT

A ball bat includes one or more stiffeners configured to provide an attenuating surface that limits the bat barrel's elastic deformation as the barrel deflects radially inwardly as a result of a particularly violent bat to ball collision. The stiffener is spaced apart from the inner surface of the barrel a predetermined distance to form a gap, wherein the gap extends only partially around the inner circumference of the barrel. The presence of the gap extending only partially around the barrel circumference provides multiple hitting profiles around the bat's circumference, with the best performance occurring adjacent the gap, and a reduced performance at all other locations around the bat's circumference.

13 Claims, 4 Drawing Sheets

BAT WITH MULTIPLE HITTING PROFILES

FIELD OF THE INVENTION

The invention relates to baseball or softball bats and more particularly, to bats that are designed to ensure safe play by limiting the bat-ball coefficient of restitution. More particularly, bats made according to the following disclosure will improve a player's performance and provide an active bat/ball interaction at slower speeds, while attenuating the bat's performance at higher bat/ball interaction speeds to promote safety and to meet existing, new or changed performance standards set by regulatory bodies.

BACKGROUND OF THE INVENTION

Most modern baseball and softball bats are typically made from aluminum, aluminum alloys, composite materials, or a combination of such materials. Bats are tubular and hollow in order to meet the weight requirements of the end user and typically have a barrel portion, a handle portion, and a tapered mid-section portion connecting the handle and barrel portions. During game play, as a pitcher throws the ball with high velocity, the batter attempts to hit the ball with the bat. Upon impact between the ball and the bat, a significant amount of the kinetic energy from the ball is transferred to the bat. The bat absorbs most of the energy, and as the ball's direction changes in response to the collision, some of the energy from the bat is transferred to the ball. Both the ball and the bat deform in response to the collision. The result is that the exit speed, the speed at which the ball leaves the bat, is usually much greater than the speed at which the ball was thrown.

A batter generally prefers a higher exit speed because it allows the ball to travel farther and it also allows the ball to get past the infield defenders before they can move to a position to intercept the ball. A ball that has an exit speed that is too high may reach the player before the player has a chance to react to either catch the ball or get out of the way. The defenders that are closer to the batter, such as the infield defenders and the pitcher especially, are at risk for being struck by a batted ball that travels at a velocity that exceeds the defender's ability to react to the hit. Consequently, there are sport governing bodies that have created and promulgated regulations to improve the safety of the sport for all of its players. One of the regulations limits the bat-ball coefficient of restitution, or BBCOR, which is a measure of bat performance by using the inbound and rebound speeds of the ball to calculate the energy transfer efficiency of the bat. This is often described as measuring the bat's "trampoline effect" or the bat's elasticity. By limiting the bat's performance, it is believed that the game will be safer for all players. There have been several approaches used for limiting a bat's performance. Some approaches reduce bat performance by stiffening the bat so that its trampoline effect is reduced.

The bat stiffening is often achieved by adding inserts to the bat to create doable walled or walled bats that utilize a secondary or tertiary tubular members that are coaxial with the barrel. Some of these multi-walled bats apply the multi-walls along the entire length of the barrel, while others only add the additional walls at preselected positions along the barrel. Other approaches are aimed at stiffening the bates sweet spot in a radial direction by providing increased thickness of the barrel at the sweet spot location. H -ever, all the approaches suffer from from one or more drawbacks. For example, many of the approaches reduce the bat efficiency for all combinations of bat/ball collision speeds. The result is that a slower bat/ball speed will produce a correspondingly slower exit speed. Furthermore, because most bats have cylindrical grips and can be held in any rotational orientation, the bat needs to have consistent hitting characteristics around the entire circumference of the bat. It is very difficult to control manufacturing tolerances to the extent necessary to ensure that a bat has a consistent hitting profile around its entire periphery. When utilizing concentric tubular members for example, minute variances in surface smoothness, ovality, straightness, concentricity, and rail thickness all compound to produce significant variability in the ba s performance along its length and at various locations around its circumference. It would be a significant improvemement in the art for a bat to perform non-linearly with respect to bat/ball collision speeds, and to attenuate the BBCOR as speeds approach the promulgated industry standards. It would also be a major improvement if a bat could be manufactured to produce consistent hitting properties at its sweet spot. It would be a further advantage if the features used for attenuating performance could be positioned in a way to give increased accuracy, thereby limiting bat-to-bat variation, and permitting less margin of error to the performance limits,

SUMMARY OF THE INVENTION

A bat includes a handle, a barrel having an outer surface and an inner surface, and a mid-section between the handle and the barrel. There is an insert positioned inside the barrel right about at the bat's sweet spot. The insert is preferably bonded or affixed to the inner surface of the barrel around less than 360 degrees of its inner perimeter. The result is that the insert makes surface contact with the inside of the barrel around a portion of the barrels inner circumference and attenuates the bat's performance along the bond interface, and the insert does not touch the inner surface of the barrel around another portion of the barrel's inner circumference. The result is a one-sided bat. The bat may also further include a directional handle that allows a batter to grip the bat with a consistent rotational orientation. The directional handle may include an ergonomic knob on the end of the handle or may be a handle shaped to fit into a player's grip in a preferred orientation. Another means to provide one-sided hitting is to annotate the bat as to the preferred hitting surface.

In some embodiments, the insert is affixed to the inner surface of the barrel around less than 270 degrees of its inner perimeter, and may be affixed at less than 180 degrees around the barrel's inner perimeter. In many embodiments, the bat is substantially cylindrical, as are most current bats being used in baseball and softball. The insert may be formed of composite materials.

The insert preferably includes a portion that is spaced apart from the inner surface of the barrel to form a gap between the insert and the inner surface of the barrel. The distance the insert is spaced apart from the inner surface of the barrel may vary axially along the barrel to provide a non-uniform gap. The gap may be filled with a shear-thickening fluid that exhibits higher viscosity at higher bat-ball collision speeds. The fluid is preferably chosen to exhibit a jump in viscosity at a desired bat-ball collision speed. The gap preferably extends only partially around the barrel's circumference, and may extend greater than 180 degrees around the barrel's circumference. The gap is generally within the range of from about 0.010 to 0.050 inches.

According to one embodiment, a bat has a cylindrical barrel with an inner surface defining a circumference and a length, and a performance attenuating insert positioned inside the barrel and having a curved surface concentric with and spaced apart from the barrel inner surface thus creating a semi-circumferential gap. The insert may be bonded to the inside of the barrel around less than half of the barrel's circumference. Alternatively, the insert may be bonded to the inside of the barrel around the entire barrel's circumference. The performance attenuating insert is preferably formed of a composite material and may be configured to interfere with radial deformation of the barrel at or above a desired bat-ball collision speed.

According to another embodiment, a hollow cylindrical bat includes a barrel section, a handle section, and a taper section extending between the barrel and handle sections. The barrel is configured with a first hitting profile around a first portion of its circumference, and configured with a second hitting profile around a second portion of its circumference. The first hitting profile preferably has a higher performance, such as a higher bat-ball coefficient of restitution, than the second hitting profile. The second hitting profile, one having a lower performance hitting profile, extends less than half way around the circumference of the barrel.

A bat may further have an insert located within the barrel at about the bat's sweet spot. The insert is shaped to create a semi-circumferential gap. The radially inward boundary of the gap is an attenuating surface of the insert that is located to inhibit radially inward deformation of the barrel once the gap compresses. The gap preferably compresses at or above a desired bat-bail collision speed to attenuate performance only at or above the desired bat-ball collision speeds. Some embodiments of a bat also include a handle or knob configured to encourage consistent rotational orientation within a batter's grip.

BRIEF DESCRIPTION OF DRAWINGS

Preferred and alternative examples of the present invention are described in detail below with reference to the following drawings, of which.

DETAILED DESCRIPTION OF TIRE PREFERRED EMBODIMENT

Embodiments of the present invention are directed to providing bats with an exceptionally stable and consistent hitting zone that repeatedly allows the bat's measured performance to approach the regulatory body standards without exceeding them. Moreover, embodiments also allow a bat to be proportionally lively at slower hitting speeds and attenuate performance as the bat/ball speed approaches or exceeds the test criteria.

During the games of baseball and softball, a batter attempts to hit a pitched ball into the field of play. The impact between bat and ball is a violent collision between two objects, and in its simplest analysis, the bat and bail each have their respective masses and velocities before and after the collision. The before and after velocities of the bat and ball are related to each other through the physical relationship known as the conservation of linear momentum. While much of the impact energy is absorbed by the ball as it undergoes significant deformation, a bat will also necessarily absorb some of the energy from the collision and will return some of this energy to the ball. The efficiency at which the bat absorbs and then returns the collision energy back to the ball is known as the bat's trampoline effect. With the advent of aluminum bats, and then later with the introduction of composite bats, players noticed that bats made of these materials had a much better trampoline effect than their wooden counterparts. These alternative material bats were very efficient at storing the impact energy in the hoop modes as the thin wall of the bat elastically deformed. Bat manufacturers wanted to maximize the trampoline effect of their bats so that hitters could get the most exit speed and distance with their hits. A bat with a relatively large trampoline effect is said to be "lively," A good batter can feel the subtle differences between bats and feel whether a bat is lively.

Figure 1:
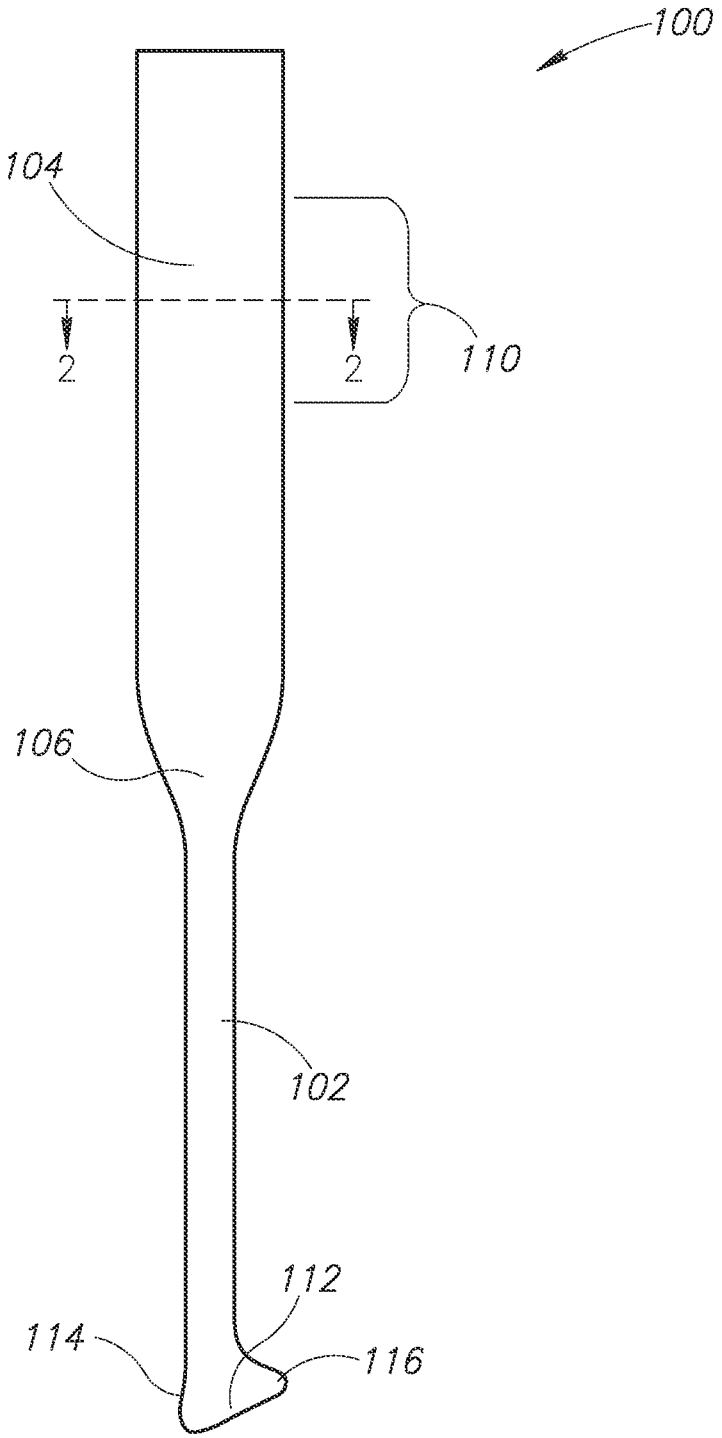
FIG. 1 is a side view of a diagram of a bat.

With reference to FIG. 1, a bat 100 typically has a handle section 102 for gripping, a barrel section 104 designed for striking a ball, and a tapered mid-section 106 that connects the handle 102 and the barrel 104. The part of the barrel best for hitting the ball, according to construction and swinging style is often called the sweet spot 110 and is usually located about 5-7 inches from the distal end of the barrel. The sweet spot of a bat exists in part because as the bat vibrates, there is a node at which point the dominant first-mode vibrations cancel each other out and the bat vibrations are not excited significantly at that spot. There are also rigid-body dynamics that affect the sweet spot, relating to the center of percussion. By hitting a ball at its sweet spot, more of the energy is transferred to the ball rather than causing vibration in the bat. Thus, the bat achieves its maximum performance when striking a ball at its sweet spot.

The regulating bodies of baseball and softball leagues want to maintain safe standards for the players. Consequently, some standards bodies have designated a performance limit on bats using a ratio of outgoing to incoming speeds measured at the bat's sweet spot, calculated to numbers the industry defines. For example, BBCOR is a measure used for baseball, BBS (batted-ball speed) is a measure used by the softball bodies, and BPF (bat performance factor) is a measure used by youth organizations. Bat manufacturers strive to maintain a balance with their bats between being lively, yet at the same time being safe and within the performance limits established by the respective governing bodies. However, achieving bat performance close to the limits without exceeding the limits can be very difficult given current manufacturing methods and tolerances.

Many of the advantages disclosed herein are possible through the realization that a bat can be created that is always held in substantially the same rotational orientation by the batter. Consequently, essentially the same hitting surface will always be used fir contacting the ball. One way to promote a repeatable rotational orientation by the batter is to produce a bat having a specialized knob 112. In traditional bats, the knob is perfectly symmetrical about a longitudinal axis of the bat, which facilitates a batter holding the bat in any rotational orientation and hitting a ball at any point around the circumference of the bat. As shown, the knob 112 has a flush portion 114 that essentially continues the line of the handle 102, and a protruding portion 116. The ergonomic shape of the knob 112 encourages a batter to hold the bat in the same rotational orientation with each swing, thereby presenting the same surface of the bat for each successive hit of the ball.

Figure 2:
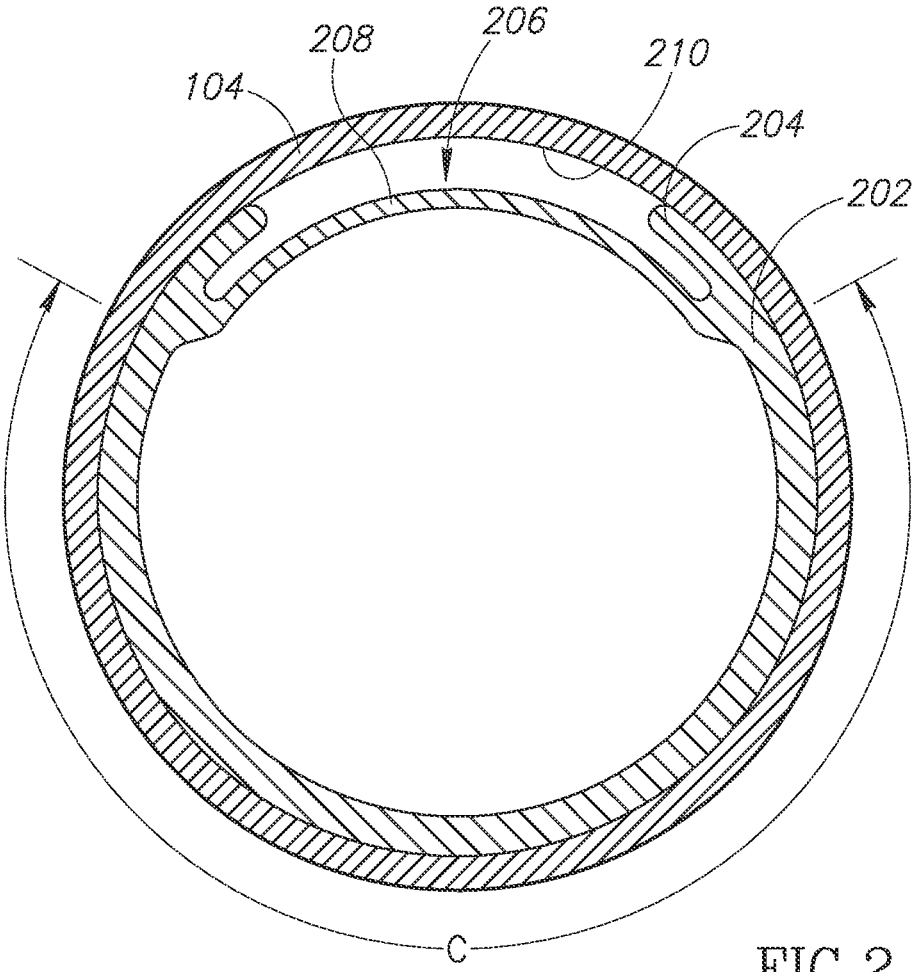
FIG. 2 is a cross-sectional view of a bat taken along the line 2-2 of FIG. 1.
Figure 3:
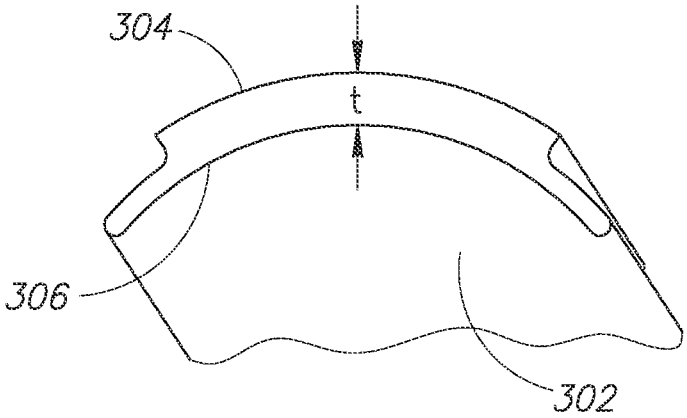
FIG. 3 is an isometric view of a shim used with the insert of FIG. 2.

With reference to FIGS. 2 and 3, a cross section of a barrel 104 is shown with a stiffening insert 202 positioned close to or at the bat's sweet spot. The stiffening insert 202 has an arc section c in which the insert 202 maintains intimate surface contact with the inside surface 210 of the barrel 104. The arc section c may contact the barrel around its inside circumference for 90 degrees, 135 degrees, 180 degrees, 220 degrees, 270 degrees, or 300 degrees or more in some embodiments. In all embodiments using this insert 202, however, the surface contact with the inside circumference of the barrel 104 is less than 360 degrees, and in many embodiments, is less than 330 degrees. The insert may be configured with one or more extensions 204 designed to provide additional surface contact with the inside of the barrel, and a stable bonding demarcation that will not de-bond or otherwise change with play. The insert 202 has an attenuating section 208 that is set off a distance from the inside wall 210 of the barrel 202 to define a gap 206 between the inner wall of the barrel 104 and the insert 202. The gap 206 is specifically designed and configured to allow the barrel 104 to elastically deform in a radial direction a predetermined distance before contacting the attenuating section 208 of the stiffening insert 202. As the barrel 104 deforms radially and contacts the attenuating section 208, further radial inward deformation is inhibited by the insert 202. In this way, the insert attenuates the bat's performance at high bat/ball speeds that would tend to elastically deform the bat beyond the limit set by the insert 202. Of course, fur bat/ball speeds that do not deform the bat sufficiently to contact the stiffening insert, the bat is free to elastically deform and feel lively as it returns this hoop mode deformation force back to the ball. As used herein, the term bat/ball speed is used to refer to the combination of ball velocity and bat velocity just prior to collision, it is typically calculated by adding the ball velocity to the swing velocity of the bat at the point of impact. According to many of the equipment testing standards, the test requires that the bat remain at rest while the ball is shot from a cannon at a specified velocity. In this instance, the bat velocity is zero just prior to impact, and the bat/ball speed would then simply be the velocity of the ball just prior to impact.

The stiffening insert 202 may be formed from any suitable material. However, some preferable materials are composite materials. Composite materials work well for this application because they are light and do not dramatically affect the weight or balance of the hat, are easily formed to a desired shape, and are able to be cured in situ. The composite materials are laid up as is known in the art and inserted into the barrel to a predetermined location and position. A shim 302 is inserted concomitantly with the insert 202 to act as a mold to help shape a portion of the insert as it cures. The shim 302 has a convex arc surface 304 that closely matches the inside surface 210 of the barrel and has a concave arc section 306 that is spaced a distance r from the convex arc surface 304 to define the shim thickness. Because the shim 302 registers off the inside surface 210 of the barrel to create the gap 206 and locate the attenuating section 208, the attenuating section 208 is precisely placed an accurate distance away from the inside surface 210 of the barrel and the gap 206 is very accurately controlled. In some embodiments, the gap is between approximately 0.001 inches to 0.100 inches. In other embodiments, the gap is between approximately 0.005 inches and 0.070 inches, and in some embodiments, is about 0.050 inches. The gap distance is preferably established based upon the bat for which the insert is contemplated and may be different for different bats. For example, the gap distance is dependent on the bat material, the wall thickness, and the attenuating properties that are desired to be built into the bat. An aluminum bat with a specified wall thickness may require a different gap than a composite bat with a different wall thickness. In some embodiments, the gap varies axially along the barrel, with the minimum gap at the sweet spot and the gap expands in one or more directions away from the minimum gap.

The composite insert may be placed and cured in any suitable manner, but in some embodiments it is placed by a sleeve that accurately locates the insert relative to the barrel end and places it at the sweet spot and also orients its rotationally as desired. The sleeve may be formed of rubber or metal and may include an inflatable bladder to apply radially outward pressure to force the insert against the inside of the barrel. The insert is cured through the application of heat, gas, chemical accelerators, or other suitable curing methods. Once the sleeve is removed, the insert 202 is precisely located, with the effects of ovality of the barrel and insert removed.

Another contribution to accuracy is that the insert is located directly behind the hitting area, on the non-hitting side of the barrel. In contrast, standard multiwall bats generally locate a cylindrical inner wall by suspending it from inserts positioned at both the proximal and distal ends of the barrel, thereby requiring very tight straightness and ovality tolerances associated with both the barrel and the insert. The insert 202 can be bonded to the inside of the bat through any suitable mechanical or chemical bonding. For example, when utilizing the insert with a metal or metal alloy bat, the bonding surface of the bat can be roughened such as by peening, sanding, etching, scratching or otherwise to promote a good site for a mechanical bond, such as an adhesive. In embodiments using a composite bat, the inside surface of the bat is generally sufficiently rough to promote good mechanical bonding, but can be mechanically worked or even smoothed to achieve sufficient surface to surface contact for a good bond with the insert. In some embodiments, chemical bonding may be preferable to securely hold the insert in place.

The shim 302 is preferably formed of a hard material that will hold its shape and act as a mold for the insert as it is located and cured in place. In some embodiments, the shim 302 is formed of stainless steel, but alternatively may be formed of other metals or suitable polymers. In addition, the shim 302 may be formed of a material that can be dissolved, melted, burned or otherwise destroyed to leave the desired gap.

The stiffening insert 202 need only be applied to the barrel 104 at or near the sweet spot, as that is the location of maximum radial deflection for a given bat/bail speed and is the location where the bat performance needs to be attenuated to ensure safety and compliance with the applicable regulations. Accordingly, the stiffening insert 202 need only be about 1 inch long, or in some embodiments, is about 2 inches long. In other preferred embodiments, the stiffening insert 202 has a length of about 3 inches, 4 inches, 5 inches, or 6 inches or more. The length of the insert is not critical so long as it is placed near the sweet spot. The risk with making the insert too long is that it could begin to alter the bat's other characteristics, such as the overall weight, the center of percussion, or the moment of inertia. The shim 302 may be the same length as the insert, or it may be formed to be longer to facilitate removal in those embodiments where the e shim is removed. In some embodiments, the shim 302 is sized to extend beyond the end of the barrel when positioning the insert to allow it to be grasped and removed more easily.

In another embodiment, the shim 302 is actually one or more shims configured to vary the gap from relatively narrow at the sweet spot, outwardly on both sides or one side to a wider gap. This enables the careful tuning of the attenuation to fit the bat's properties.

In another embodiment, instead of an air gap, a nonlinear shear thickening fluid is contained in the gap. This gives another measure of control, since the shear-thickening fluid gives much greater viscosity at higher shear rates, thereby dynamically stiffening the barrel at higher speeds. The shear fluid is preferably chosen to exhibit a jump in viscosity when shear forces correspond to a desired bat-ball collision speed.

Figure 4:
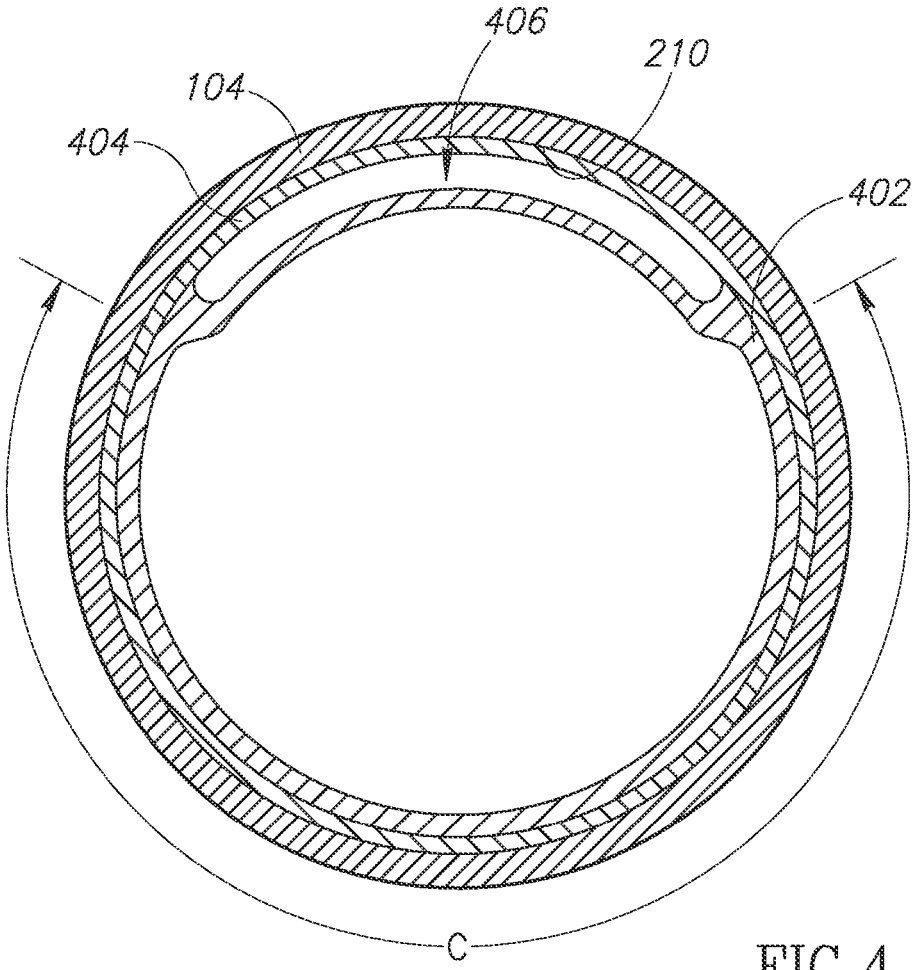
FIG. 4 is a cross-sectional view of a bat taken along the line 2-2 of FIG. 1 showing an alternate insert.
Figure 5:
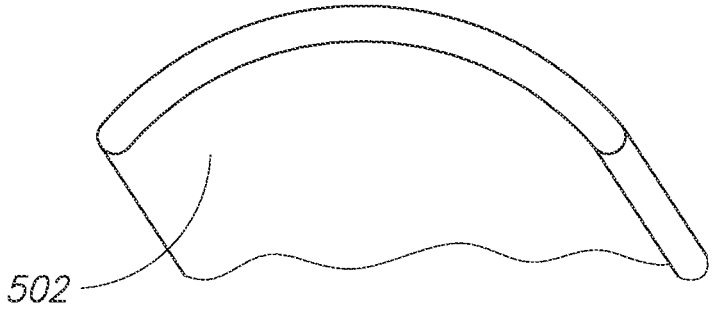
FIG. 5 is an isometric view of a shim used with the insert of FIG. 4.

With reference to FIGS. 4 and 5, another embodiment of a stiffening insert 402 is shown. This embodiment is similar) that shown in FIG. 2 with the addition of a circular bonding tube 404 that contacts the entire circumference along the inner wall 210 of the barrel 104. The bonding tube 404 is affixed to the stiffening insert 402 along a portion of its circumference; however, there is a designed gap 406 between the bonding tube 404 and the stiffening insert 402. The gap 406 may be formed as already described, by inserting a shim 502 between the bonding tube 404 and the insert 402 and then curing the components to accurately form and position the gap 406. Preferably, the bonding tube 404 is designed so that its resiliency is factored into the design of the bat and the addition of the bonding tube 404 in contact around the entire circumference of the inner wall 210 of the barrel 104 does not adversely affect the performance of the bat. The bonding tube 404 and the insert 402 are preferably bonded together sufficiently to provide a secure attachment to the barrel to inhibit dislocation of the insert either along the length of the bat or rotationally inside the barrel. This can be accomplished with suitable adhesives and/or with mechanical or chemical bonding. Of course, the bonding tube 404 and insert 402 may be formed integrally with one another. For example, during layup of composite material to form the insert, the shim can be inserted in between the layers of composite material to form the gap, One advantage to the embodiment shown in FIG. 4, and embodiments like it, is that the entire assembly including the bonding tube 404 and insert 402 may be formed and cured outside the barrel 104 and then appropriately positioned into the barrel and affixed in place. This method of pre-fabricating the insert may prove to be easier than placing an uncured insert appropriately and then curing it in situ. For example, by pre-fabricating the insert, the manufacturer can select an adhesive with an acceptable open working time to allow the insert to be exactly positioned before the adhesive begins to cure. Moreover, the insert can be inspected for roundness and diameter to ensure it will make adequate surface contact with the barrel before it is installed. To facilitate removal of the shim in those embodiments where removal is desired, the shim can be formed of a lubricious material, such as a suitable polymer to prevent it from adhering to the barrel 104 or the insert 402. It may also be coated with a suitable release agent, such as silicone or cellophane, or other coating or sheet barrier that prevents it from becoming permanently affixed inside the barrel. Once a shim is removed from a barrel, it can be reused in subsequent applications.

Figure 6:
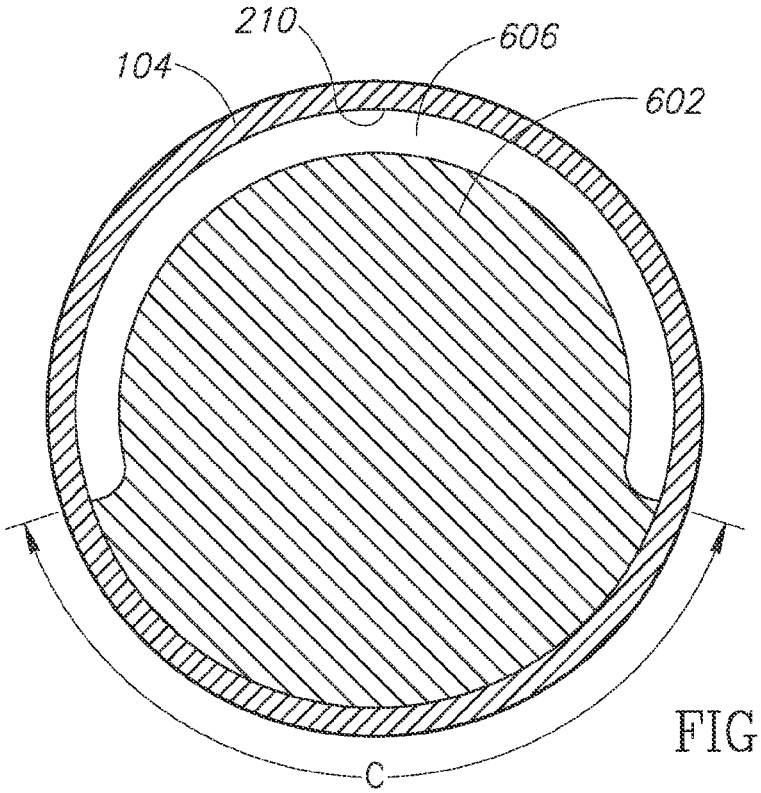
FIG. 6 is a cross-sectional view of a bat taken along the line 2-2 of FIG. 1 showing an alternate insert

With reference to FIG. 6, another embodiment of a stiffening insert 602 is shown. In this embodiment, the insert 602 is substantially solid and fills most of the hollow interior of the barrel 104. The insert 602 may be made of any suitable material, such as rigid or semi-rigid foam, plastic, or wood. The insert 602 can be partially cured prior to insertion into the barrel 104 and then fully cured once in place. Alternatively, the insert 602 can be fully cured prior to placement inside the barrel 104, and then positioned and affixed to the inside of the barrel. A shim as has been described herein can be used to properly form the gap 606 between the barrel inner wail 210 and the insert 602. The disclosed method of using a shim to register off the barrel ensures that an appropriate gap is created and that the variables inherent in bat manufacture, such as barrel straightness, ovality, and wall thickness, are obviated. The insert 602 can be configured to produce any size or geometry gap as desired. For example, the gap 606 can vary in its radial distance away from the barrel inner surface 210 and can be configured with a minimum gap distance at the sweet spot and can gradually increase along the barrel's axial direction. The gap can also extend around the inner circumference of the barrel any desired angular distance C. In some embodiments, the angular distance C is 120 degrees, or 180 degrees, or more.

Figure 7:
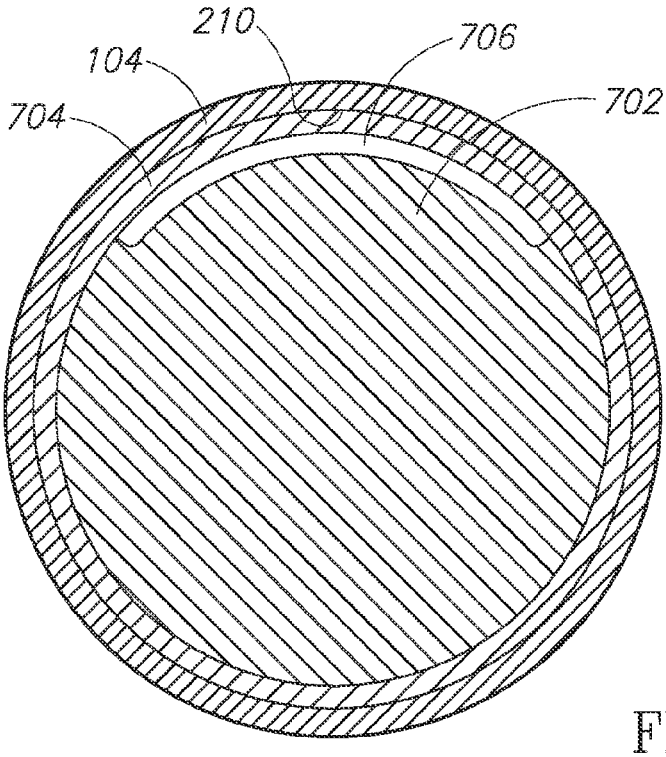
FIG. 7 is a cross-sectional view of a bat taken along the line 2-2 of FIG. 1 showing an alternate insert.

With reference to FIG. 7, a substantially solid insert 702 is formed inside a bonding tube 704. The insert 702 may be made of any suitable material, but in some preferred embodiments, is formed of foam, such as polystyrene, polyurethane, or other substantially rigid foam. In another preferred embodiment, it is made of wood. The insert 702 is encased in a bonding tube 704 that is generally cylindrical in shape. The bonding tube 704 is configured to contact the barrel inner wall 210 around its entire circumference. The insert 702 is configured to contact the inner surface of the bonding tube 704 around only a portion of its inner wall, thus forming a gap 706 between the insert 702 and the bonding tube 704. The gap may be formed by any suitable method, but in some preferred embodiments, is formed by using a removable shim as described herein, which allows precise gap dimensions with tight tolerances. The gap may also extend any suitable distance around the circumference of the bonding tube or the barrel. For example, the gap defines the zone of the bat that is best suited for hitting. A batter will typically roll their hands during the swing thus rotating the bat at different points during the swing. The gap is preferably adjacent to the point of the barrel that makes contact with the ball, and for this reason, the gap may extend 90 degrees, or 180 degrees, or even 270 degrees along the circumference of the barrel. The insert may be formed and cured in situ, but in one particularly advantageous embodiment, the insert and bonding tube are formed and cured prior to insertion into a bat. In fact, the insert 702 and bonding tube 704 can be formed of any length and then cut to form multiple inserts. The finished inserts can then be positioned and affixed inside a bat barrel as desired.

The disclosed embodiments provide the particular advantage of a performance attenuating insert that is passive at relatively low bat/ball speeds to allow the bat to feel very lively, yet as the bat/ball speeds approach the danger zone as established by regulatory bodies, the bat performance is attenuated to meet the performance limitations. Thus, players who have slower swing speeds will be able to take advantage of the trampoline effect a hollow bat provides and at the same time, defensive players will be kept safe from batters with faster swing speeds.

It will be appreciated that the disclosure herein of inserts for bats should not he constrained to a bat made of a specific material. Conversely, the inserts disclosed herein can be utilized with any hollow bat formed of any material or configuration.

While several preferred embodiments of the invention have been illustrated and described, as noted above, many changes can be made without departing from the spirit and scope of the invention. Accordingly, the scope of the invention is not limited by he disclosure of the preferred embodiments. Moreover, bats are made of a multitude of different materials and combinations of materials. Nothing herein should be interpreted as limiting the invention to a bat made of a particular material or designed to be used with a particular sport. Similarly, bats are constructed to have many different lengths, weights, and geometries used in the various bat and ball sports, and while the disclosure herein may focus on a bat having a specific length and weight produced for one particular sport, this should not be construed as limiting on the invention as a whole. Instead, the invention should be determined entirely by reference to the claims that follow.

The invention claimed is:

1. A bat, comprising:

a cylindrical barrel having an inner surface defining a circumference and a length, and a performance attenuating insert positioned inside the barrel and having a first curved surface that is concentric and makes contact with a first portion of the circumference of the barrel's inner surface and a second curved surface that is spaced apart from a second portion of the circumference of the barrel's inner surface such that a semi-circumferential gap is formed between the second curved surface of the insert and the second portion of the circumference of the barrel's inner surface, wherein the gap is concentric with the barrel's inner surface.

2. The bat of claim 1, wherein the first curved surface of the performance attenuating insert is bonded to the first portion of the circumference of the barrel's inner surface and the first portion of the circumference is less than half of the circumference of the barrel's inner surface.

3. The bat of claim 1, wherein the first curved surface of the performance attenuating insert is bonded to the first portion of the circumference of the barrel's inner surface and the first portion of the circumference is greater than half of the circumference of the barrel's inner surface.

4. The bat of claim 1, wherein the performance attenuating insert is formed of a composite material.

5. The bat of claim 1, wherein the performance attenuating insert is configured to interfere with radial deformation of the barrel at or above a desired bat-ball collision speed.

6. A hollow cylindrical bat comprising a hollow barrel section that includes an inner surface and an outer surface, a handle section, an insert positioned within the barrel section that includes an arc-shaped surface and an attenuating surface, and a taper section extending between the barrel and handle sections, wherein the arc-shaped surface of the insert maintains surface contact with a first portion of the inner surface of the barrel section to configure a first hitting profile around a first portion of the outer surface of the barrel section that corresponds to the first portion of the inner surface of the barrel section, and the attenuating surface of the insert is set off a distance from a second portion of the inner surface of the barrel section to form a semi-circumferential gap and configure a second hitting profile around a second portion of the outer surface of the barrel section that corresponds to the second portion of the inner surface of the barrel section, wherein the gap is concentric with the inner surface of the barrel section.

7. The bat of claim 6, wherein the first hitting profile exhibits a higher stiffness than the second hitting profile.

8. The bat of claim 6, wherein the second portion of the outer surface of the barrel section extends less than half way around the outer surface of the barrel section.

9. The bat of claim 6, wherein the insert positioned within the barrel section is proximate to a sweet spot of the bat, the attenuating surface of the insert defines a radially inward boundary of the gap that is configured to inhibit radially inward deformation once the gap compresses an amount equivalent to the distance that the attenuating surface is offset from the second portion of the inner surface of the barrel section.

10. The bat of claim 6, wherein the gap is configured to compress at or above a desired bat-ball collision speed.

11. The bat of claim 6, further comprising a knob on the end of the handle section configured to encourage consistent rotational orientation within a batter's grip.

12. A bat, comprising:

a handle, a barrel having an outer surface and an inner surface, and a mid-section between the handle and the barrel; and an insert positioned inside the barrel proximate the bat's sweet spot, wherein the insert is affixed to the inner surface of the barrel around less than 360 degrees of its inner perimeter, and wherein a portion of the insert is spaced apart from the inner surface of the barrel to form a gap between the insert and the inner surface of the barrel that is filled with a shear-thickening fluid that exhibits higher viscosity at higher bat-ball collision speeds.

13. The bat of claim 12, wherein the fluid exhibits a jump in viscosity at a desired bat-ball collision speed.

* * * * *